US009431223B2

(12) United States Patent
Makarov

(10) Patent No.: US 9,431,223 B2
(45) Date of Patent: Aug. 30, 2016

(54) IMAGING MASS SPECTROMETRY METHOD AND DEVICE

(71) Applicant: Thermo Fisher Scientific (Bremen) GmbH, Bremen (DE)

(72) Inventor: Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/016,736

(22) Filed: Feb. 5, 2016

(65) Prior Publication Data

US 2016/0155620 A1 Jun. 2, 2016

Related U.S. Application Data

(63) Continuation of application No. 14/722,930, filed on May 27, 2015, now Pat. No. 9,263,242.

(30) Foreign Application Priority Data

Jun. 2, 2014 (GB) ..... 1409763.8

(51) Int. Cl.
*H01J 49/00* (2006.01)
*H01J 49/40* (2006.01)
*H01J 49/42* (2006.01)

(52) U.S. Cl.
CPC ..... *H01J 49/0004* (2013.01); *H01J 49/0031* (2013.01); *H01J 49/40* (2013.01); *H01J 49/4265* (2013.01)

(58) Field of Classification Search
USPC ..... 250/281, 282
See application file for complete search history.

(56) References Cited

U.S. PATENT DOCUMENTS

| | | | | |
|---|---|---|---|---|
| 5,808,300 | A | 9/1998 | Caprioli | |
| 6,734,421 | B2 | 5/2004 | Holle et al. | |
| 7,655,476 | B2 | 2/2010 | Bui | |
| 8,274,045 | B2 | 9/2012 | Bamberger et al. | |
| 2006/0247863 | A1* | 11/2006 | Bui | G06T 7/0004 702/19 |

(Continued)

FOREIGN PATENT DOCUMENTS

GB 2517530 A 2/2015

OTHER PUBLICATIONS

Amitay et al., "A new type of multiparticle three-dimensional imaging detector with subnanosecond time resolution," Rev. Sci. Instrum. 68 (3), 1997, 1387-1392.

(Continued)

*Primary Examiner* — Kiet T Nguyen
(74) *Attorney, Agent, or Firm* — David A. Schell

(57) ABSTRACT

A method of performing imaging mass spectrometry of a sample. The method comprises performing a first mass analysis of the sample using a first mass analyzer comprising a multi-pixel ion detector to obtain first mass spectral data representative of pixels of the sample. The method further comprises identifying clusters of pixels sharing one or more characteristics of first mass spectral data. The method also comprises performing a second mass analysis of the sample using a second mass analyzer to obtain second mass spectral data at at least one location in each cluster, wherein the number of locations is significantly less than the number of pixels in each cluster, said second mass analysis being of higher resolution than said first mass analysis. Also a mass spectrometry apparatus configured for carrying out the method.

22 Claims, 5 Drawing Sheets

(56) References Cited

U.S. PATENT DOCUMENTS

| | | | |
|---|---|---|---|
| 2007/0141719 | A1 | 6/2007 | Bui |
| 2011/0216952 | A1 | 9/2011 | Kajihara |

OTHER PUBLICATIONS

Hazama et al., "Development of a stigmatic mass microscope using laser desorption/ionization and a multi-turn time-of-flight mass spectrometer," J. Biomed. Opt. 16(4), 046007 (2011).

Jagutzki et al., "A broad-application microchannel-plate detector system for advanced particle or photon detection tasks: large area imaging, precise multi-hit timing information and high detection rate," Nucl. Instrum. Meth. Phys. Res. A, 477, 2002, 244-249.

Kiss et al., "Microscope mode secondary ion mass spectrometry imaging with a Timepix detector," Rev. Sci. Instrum. 84, 013704 (2013).

Llopart et al., "Timepix, a 65k programmable pixel readout chip for arrival time, energy and/or photon counting measurements," Nucl. Instrum. Meth. Phys. Res. A 581, 2007, 485-494.

* cited by examiner

IMAGING MASS SPECTROMETRY METHOD AND DEVICE

CROSS-REFERENCE TO RELATED APPLICATIONS

The present application is a continuation under 35 U.S.C. §120 and claims the priority benefit of co-pending U.S. patent application Ser. No. 14/722,930, filed May 27, 2015, which application is incorporated herein by reference in its entirety.

FIELD OF THE INVENTION

The invention relates to a method of improved imaging mass spectrometry and a device for performing the same.

BACKGROUND TO THE INVENTION

Mass spectrometry imaging (MSI) is increasingly used for a wide range of applications, from measuring distribution of metabolites within tissues sections to histology. Spatial resolutions typically range from few to hundreds of microns.

Two approaches are generally used to acquire an image of a flat sample.

One approach to MSI is that of rastering, as explained in U.S. Pat. No. 5,808,300. A narrow focused ionization beam (for example, a laser beam for MALDI, LAESI, LDI, etc., primary ion beam for SIMS, primary droplet beam for DESI, primary metastable beam for DART, etc.) is used to produce ions from a small spot to be analysed by a mass spectrometer. As a surface is rastered under the beam, individual pixels are probed sequentially and corresponding data are assembled into an image. This method allows high-resolution, high mass accuracy analysis (including multi-stage mass spectrometry or MSn) by a range of different types of mass spectrometers (TOF, FTICR, ORBITRAP™, linear trap stand-alone and hybrid instruments), sampling at atmospheric pressure and other advantages. Unfortunately, this rastering approach also has a significant disadvantage in that, since time of measurement is directly proportional to the number of pixels in the image, a scan might take many hours or even days. This greatly hinders the use of MSI in general analytical and industry practice.

To circumvent this limitation with the rastering approach, one possibility is to split the ionising beam into multiple beams with subsequent multiplexed MS analysis (U.S. Pat. No. 6,734,421 by Franzen). Alternatively, the image could be acquired first at a low spatial resolution (per the method disclosed in U.S. Pat. No. 7,655,476 by H. Bui) and then only areas of interest (for example, areas with highly differentiated analyte abundances) are sampled with high spatial resolution. However, these approaches do not allow a significant reduction in the measurement time.

As an alternative to rastering, a second approach to MSI is similar to the one used in optical imaging: acquisition of a panoramic spectrum using a 2D array of detectors. This approach takes its roots from position-sensitive detectors used in TOF (as shown e.g. in O. Jagutzki et al., Nucl. Instrum. Meth. Phys. Res. A, 477 (2002) 244-249) and 1D arrays (e.g. Z. Amitay and D. Zajfman, Rev. Sci. Instrum. 68 (3) (1997) 1387-1392) and capitalizes on the great advances in microelectronics over the last decades. A 65 kpixel TIMEPIX chip was presented in X. Llopart et al. Nucl. Instrum. Meth. Phys. Res. A 581 (2007) 485-494 and utilised for ion detection with a simple linear MALDI-TOF analyser in U.S. Pat. No. 8,274,045 and with a SIMS-TOF in A. Kiss et al., Rev. Sci. Instrum. 84, 013704 (2013). Though the chip allows for the possibility of acquiring tens of thousands pixels in parallel, temporal resolution of the current chip barely suffices for unit resolution up to moderate m/z (few hundreds) and does not allow resolution of isobaric interferences or effective identification of peaks. Also, the chip must operate in high vacuum as it uses microchannel plates (MCP) for conversion of incoming high-energy ions into electrons and electron multiplication. Further improvement of temporal resolution of electronics would improve mass resolution but inherent energy spread in laser ionization would allow further increase of mass resolution only at the expense of spatial resolution. This is clearly demonstrated by H. Hazama et al. in J. Biomed. Opt. 16(4), 046007 (2011) using multi-turn TOFMS of the MULTUM type to increase mass resolution where the image quality deteriorates rapidly with the increase of the number of turns.

The limitations of the rastering technique and the 2D array of detectors technique are addressed by the present invention.

SUMMARY OF THE INVENTION

Against this background, there is provided a method of performing imaging mass spectrometry of a sample, the method comprising:

performing a first mass analysis of the sample using a first mass analyser comprising a multi-pixel ion detector to obtain first mass spectral data representative of pixels of the sample;

identifying clusters of pixels sharing one or more characteristics of first mass spectral data; and performing a second mass analysis of the sample using a second mass analyser to obtain second mass spectral data at at least one location in each cluster, wherein the number of locations is significantly less than the number of pixels in each cluster, said second mass analysis being of higher resolution than said first mass analysis.

Advantageously, a higher resolution result may be achieved with reasonable confidence of accuracy without having to perform a higher resolution mass analysis across an entire frame or sample. In this way, higher resolution mass analysis data can be achieved for a sample in a fraction of the time which would be required to perform higher resolution mass analysis across every pixel of the sample.

In a further aspect of the invention there is provided a mass spectrometry apparatus comprising:

a first mass analyser comprising a multi-pixel ion detector for undertaking first mass analysis of a sample to provide first mass spectral data in the form of a mass spectral image of the sample;

a second mass analyser for undertaking second mass analysis of the sample to provide second mass spectral data of higher mass resolution than the first mass spectral data;

a controller configured:

to analyse the mass spectral image;

to identify within that mass spectral image clusters of spectrally similar pixels;

to configure the second mass analyser to analyse one or more locations within each cluster to a higher resolution than that provided by the first mass analyser, wherein the number of locations is significantly less than the number of pixels in each cluster.

Advantageously, the apparatus can achieve high resolution mass analysis data for a sample in a fraction of the time that would be required to perform high resolution mass analysis for every pixel of the sample.

Further preferred features of the present invention are set out in the appended claims.

BRIEF DESCRIPTION OF THE DRAWINGS

The invention may be put into practice in a number of ways and some preferred embodiments will now be described by way of example only and with reference to the accompanying drawings in which.

DETAILED DESCRIPTION OF A PREFERRED EMBODIMENT

Figure 1:
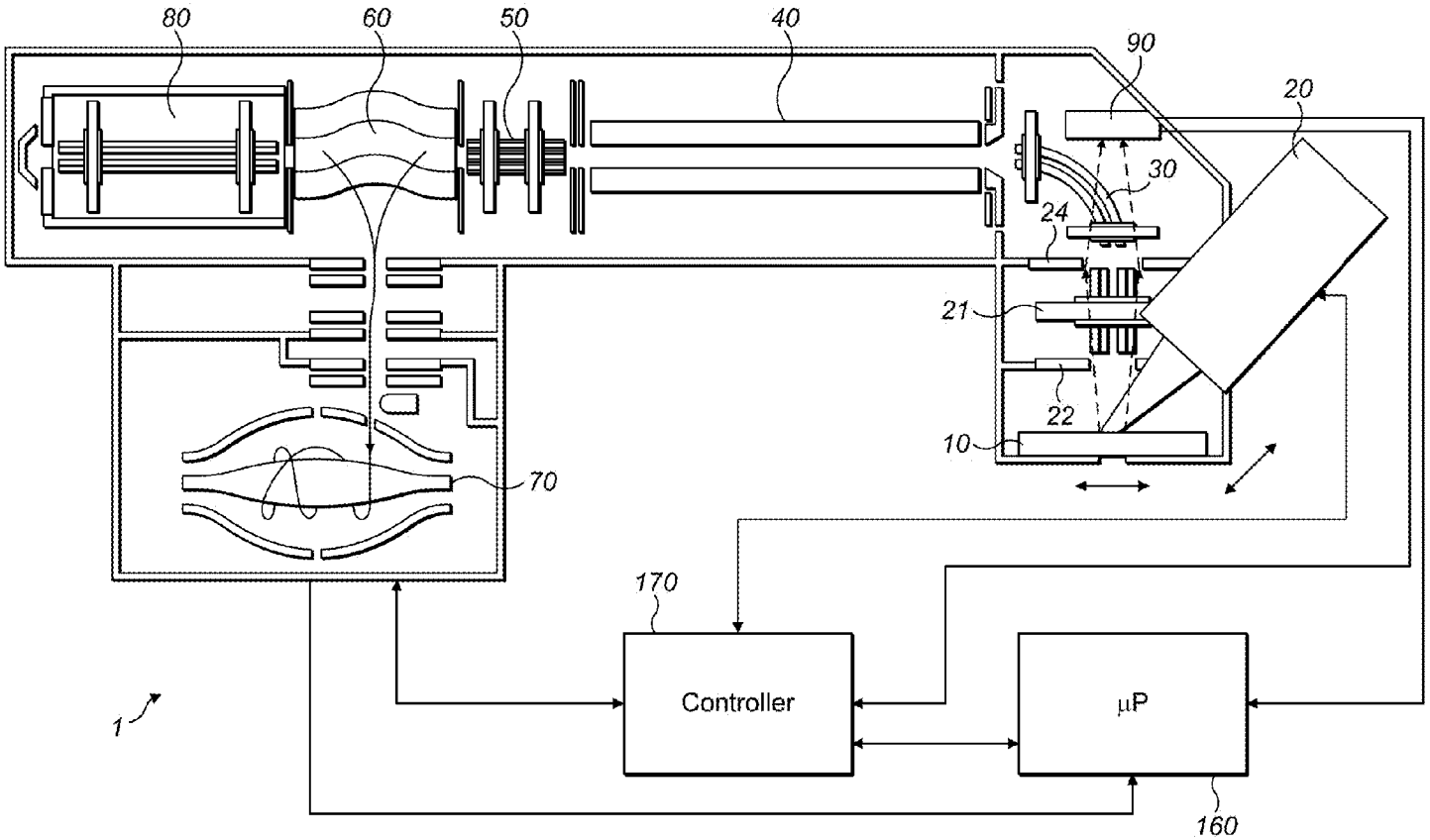
FIG. 1 shows a first embodiment of a mass spectrometer embodying the present invention.

FIG. 1 shows, in schematic form, a mass spectrometer 1 in accordance with an embodiment of the present invention. The mass spectrometer 1 comprises a sample receiving portion 10, an ion source 20 such as a laser, first ion optics 21, a 2D detector 90, a quadrupole mass filter 40, second ion optics 50, a C-trap 60, an ORBITRAP™ analyser 70 and a collision cell 80.

The sample receiving portion 10 may comprise a plate. The sample receiving portion is used for supporting the sample to be analysed, i.e. imaged, as known in the art. The sample, for example, may be a tissue sample. The sample receiving portion may be mounted on a manipulator to allow rastering of the sample surface. The sample receiving portion is typically held in high vacuum (preferably at a pressure below $10^{-5}$ mbar).

The ion source 20 may comprise any suitable ionization source for time of flight (TOF) analysis, and thus is generally a pulsed ion source, or at least operable as a pulsed source for the first mass analysis. The ion source 20 is preferably an ionization source that can be rastered across the surface of the sample to be imaged. The ionization source is preferably one that can be narrowly focused to a small spot size (e.g. preferably between 10 and 30 μm, or less). Examples of suitable ionization source include a laser beam (pulsed), which may be suitable for MALDI, LAESI, LDI, etc., or a primary ion beam which may be suitable for SIMS, or a primary droplet beam which may be suitable for DESI, or a primary metastable beam which may be suitable for DART. A preferred source is a (pulsed) laser beam. The arrangement of sample and ion source allow for ions to be generated from the surface of the sample, i.e. in pulses wherein the ions can be subsequently separated and detected according to their time of flight. Each pulse of ions constitutes an ionization event and there may be multiple ionization events from which the ions are separated and detected.

The 2D detector 90 is an example of the multi-pixel ion detector used to perform the first mass analysis of the present invention. The multi-pixel ion detector may comprise at least 50 kpixels. A suitable 2D multi-pixel detector with fast response may comprise a TimePix chip or similar, e.g. a 65 kpixel TimePix chip.

The sample, 2D detector and intervening ion optics are preferably arranged to provide a linear ion flight path, for example as shown in FIG. 1.

The first ion optics 21 includes an accelerator lens 22 and a focus lens arrangement 24.

Figure 2:
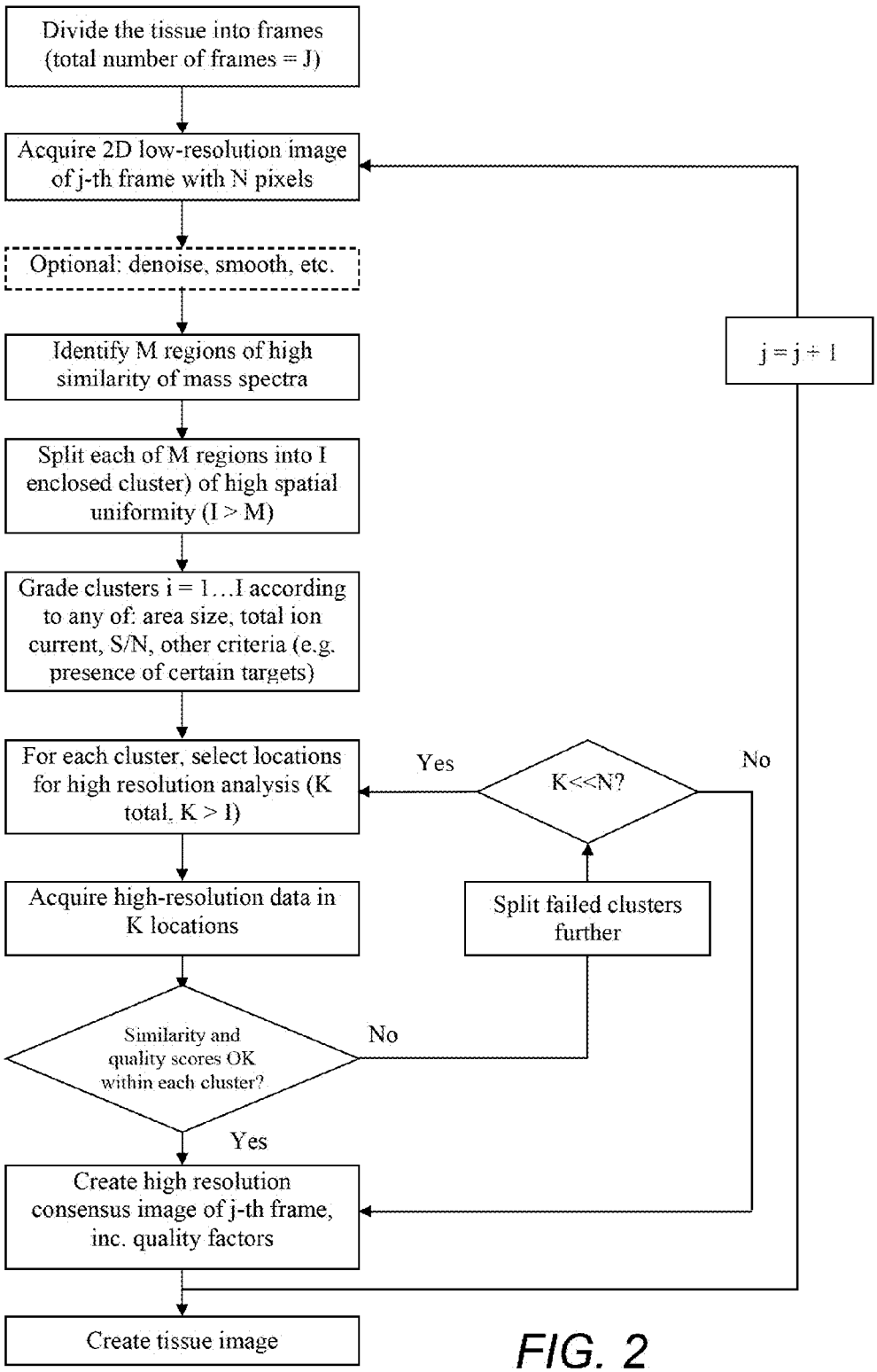
FIG. 2 shows a flow chart illustrating the steps of a method embodying the present invention.

The process of analysis performed by the apparatus of FIG. 1 is illustrated by the flow chart of FIG. 2.

Figure 3:
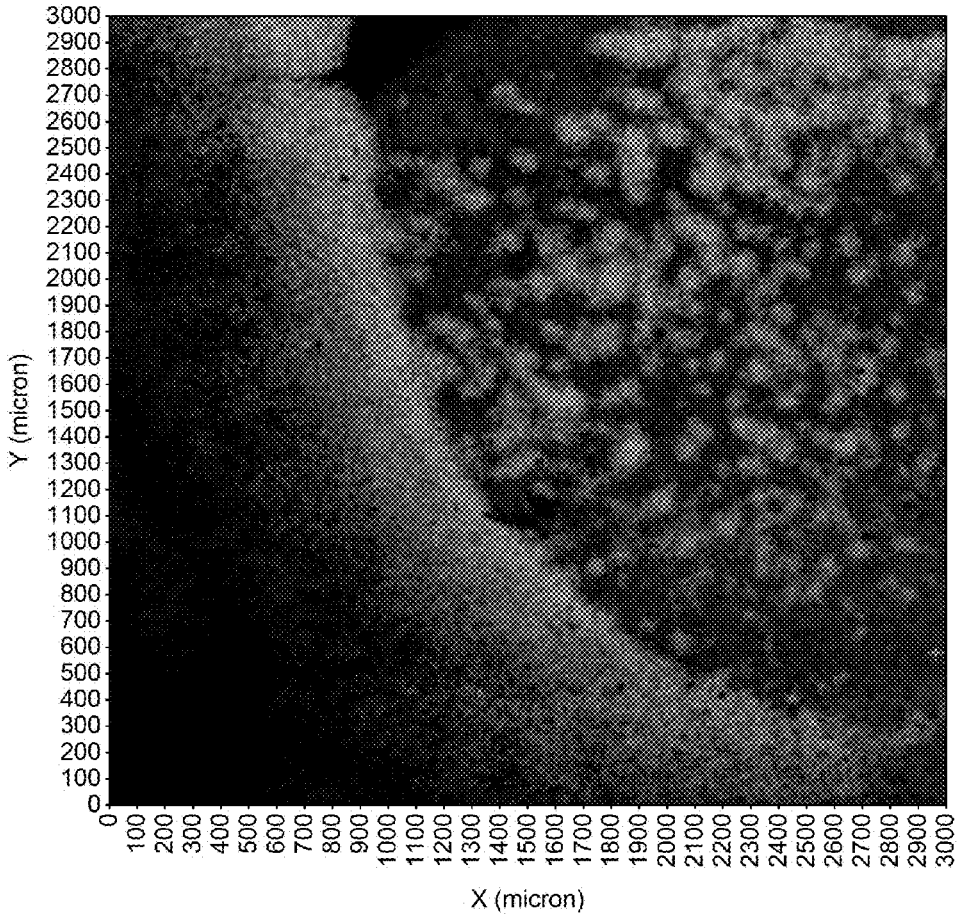
FIG. 3 shows an image obtained from 2D mass spectrometry imaging analysis of a sample in accordance with an embodiment of the present invention.

In a first stage of the analysis, a wide area, low mass resolution image is obtained using the 2D detector 90. The wide area may comprise the entire area of the sample. However, it is more likely that the wide area may comprise a part of the sample, which for the purpose of this description is termed a frame. An example of a frame is shown in FIG. 3. This example frame is 3 mm×3 mm, which equates to 300 pixels×300 pixels. A number of frames, J, may cover the entire sample or an area of interest on the sample.

For the wide area, low mass resolution analysis, the ion source 20 is arranged to direct a beam (e.g. laser or ion pulse) towards the sample surface to provide a uniform ionization area spread over a wide area (a frame), covering up to the full sample, but typically a part of the sample. The beam generates ions from the ionization area of sample surface. The generated ions are accelerated to high energy (of the order of 10 kV to 30 kV) by the accelerator lens 22. Subsequently, the ionization area is projected by focus lens 24 onto the 2D detector 90 as the focus lens focuses the accelerated ions onto the 2D detector. The sample receiving portion 10, accelerator lens 22, focus lens 24 and 2D detector 90 are all located on a straight line such that the flight path of ions from the sample surface to the 2D detector is linear. The ions become separated according to their time of flight to reach the detector, which is determined by their m/z. The first mass analysis in this example is thus a TOF mass analysis with imaging.

The accelerator lens 22 is preferably a gridless accelerator lens. The focus lens arrangement 24 may be a single lens or a set of lenses, preferably of achromatic type (e.g. cylindrical) so as to reduce aberrations. Magnification provided by the focus lens 24 may be fixed (preferably in the range 0.1 to 10) or variable by adjusting one or more voltages on the focus lens. Multiple ionization events (10s to 10,000s) allow for the detection of ions at every pixel and obtain a good signal-to-noise ratio for every pixel. Modern kHz lasers can allow such accumulation of detection to take just a few seconds.

The 2D detector may enable the acquisition of tens to hundreds of thousands (for multi-chip detectors) of pixels in parallel with a temporal resolution that currently limits the m/z resolving power compared to high mass resolution analysis. Typically, the temporal resolution of the 2D detector currently limits the m/z resolving power to just unit mass resolution. The output of the 2D detector is the first mass spectral data of the present invention.

The output of the 2D detector array 90 is captured by a microprocessor 160. The mass spectrometer 10 is under the overall control of a controller 170. In FIG. 1, the controller's main connections, insofar as they are relevant to the understanding of the present invention, are illustrated in schematic form but it will of course be understood that the controller may control other parts of the mass spectrometer as well. It will also, of course, be understood that the controller 170 and the microprocessor 160 may in reality be formed as a part of the same either dedicated processing circuitry or computer.

Figure 4:
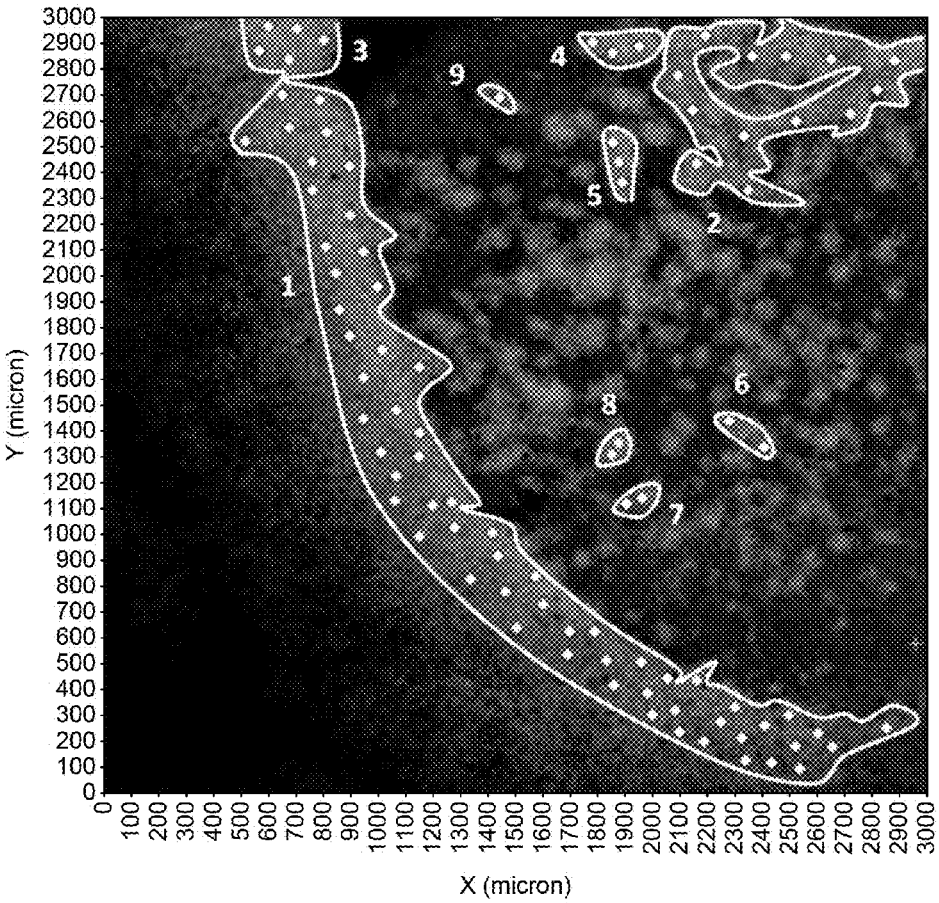
FIG. 4 shows the image FIG. 3 with regions identified from a first analysis in accordance with an embodiment of the invention.

Having obtained a 2D image, i.e. mass spectrometric image, of the frame, this 2D image is processed, i.e. by the controller 170 and/or microprocessor 160. Processing of the 2D image may involve smoothing and/or de-noising. Then distinct regions of the frame are identified by grouping pixels in the 2D image that exhibit a sufficient degree of similarity, i.e. share one or more characteristics of the first mass spectral data (e.g. one or more shared m/z peaks). A hierarchy of differentiation may be used, and may involve a grouping technique such as principal component analysis (PCA) or cross-correlation. In the example of FIG. 4, one such (non-continuous) region is called out by white perimeter lines. Generally, the identified region(s) may be continuous or non-continuous. This region identified in FIG. 4 corresponds to one of potentially multiple regions (total number M) as identified in FIG. 2. As an example there may be 10-30 regions identified in this way, although this number range is not at all limiting.

Determining the locations of the white lines that delimit the (or each) region may be achieved by a process of clustering that may make use of a grouping technique. Once this process is complete, there is at least one region (maybe or maybe not continuous) that, on the basis of the lower resolution analysis, appears to have a degree of spectral similarity among its pixels. It may be that every pixel across the entire frame is allocated to a region. Alternatively, it may be that only some pixels of the total pixels in the frame are allocated to a region. In the event, for example, that a particular analysis is being used to identify the presence or absence of a particular substance (target) then it may be that only those pixels of the frame that appear, on the basis of the wide area, first low mass resolution analysis, to represent areas having sufficient spectral similarity to the spectrum of the intended target substance will be included in a region. Conversely, pixels that appear, on the basis of the wide area, first low mass resolution analysis to represent areas having insufficient spectral similarity to the spectrum of the intended substance may not be included in any region.

Sub-regions, or "clusters", within each region may further be identified. The clusters may be continuous regions. Generally, the clusters are sub-regions of high spatial uniformity within each region. Accordingly, in the example of FIG. 4, there are 9 clusters. As an example, there may be 5-20 sub-regions or clusters indentified in this way in each region, although this number range is not at all limiting. It will be appreciated, however, that the total number of clusters, I, is greater than the number of regions M (I>M). Again a hierarchy of differentiation may be used, and may involve a grouping technique such as principal component analysis (PCA) or cross-correlation. The clusters may be graded or ordered, for example with regard to one of the following criteria: area size; total ion current or count; signal to noise ratio; evidence of the presence of a particular target. In the example of FIG. 4, the hierarchy of clusters is illustrated by the numbers 1 to 9.

In many cases, an entire image may be split into hundreds of clusters, i.e. the shown 9 clusters would be just the tip of the iceberg shown for illustration. However, in many (e.g. clinical) applications it is expected to have some additional information that would allow elimination of some clusters from the analysis, e.g. based on a list of m/z of interest (so that only clusters with peaks at such m/z are retained) or those of minimum area size, etc.

Subsequently, a representative set of K locations is selected in each cluster, each location comprising a single pixel or small number of pixels, is identified for further, higher mass resolution, analysis. In general there is at least one location in each cluster, preferably a plurality of locations in each cluster (i.e. K>I). Each location is selected as representative of a wider area of pixels within the cluster. In general, the number of locations is significantly or substantially less than the total number of pixels in each cluster. There may be a number of locations selected within each region, and/or a number of locations selected within each cluster, dependent on factors such as the size of the region and/or cluster. In the example of FIG. 4, each location is identified by a white square/diamond.

Having identified a number of locations, a second mass analysis that is a high mass resolution analysis is performed at each of those locations, sequentially. The second, high resolution, mass analysis is controlled by the controller 170 and the results of the high resolution analysis are captured by the microprocessor 160.

For the second, high resolution, mass analysis, the effective spot size of the beam (laser or ion beam) derived from the source 20 is adjusted using a lens, or is otherwise physically adjusted, so as to cover an area equivalent to a small number of pixels of the 2D image at each location. Preferably, the laser or primary ion beam will cover the broad image area when working in the first mass analysis mode and there the beam power needs to be adjusted to work just above threshold, otherwise the pixels of the 2D detector may become saturated. Meanwhile, for the second, high resolution mass analysis, the beam needs to be focused and work with significantly higher power to provide a sufficiently high ion current for detection.

For the high mass resolution analysis, instead of the ions from each location being directed to the 2D detector of the first mass analyser, they are directed to a second mass analyser of higher mass resolution. After passing through the focus lens the ions are guided by a bent multipole 30 or other means for diverting the flow of ions towards the second mass analyser. The bent multipole 30 and optionally other downstream optics were switched off while the first mass analysis is preformed but are now switched on. The bent multipole 30 acts to decelerate ions and RF causes ions to be guided in a curved path. The first ion optics 21, bent multipole 30 and all downstream components are held under vacuum. The ions then enter a quadrupole mass filter 40. Ions of a particular species to be investigated can be selected by the quadrupole mass filter 40 or it may be operated in RF mode to substantially transmit ions of a broad m/z range. For example, a single charge state or single modification may be selected. The selected, or non-selected, ions then pass from the quadrupole mass filter 40, through the second ion optics 50 and into the curved linear ion trap (C-trap) 60.

Optionally, there may be a collision multipole between the bent multipole 30 and the quadrupole mass filter 40 in order to compress the ion beam at this point.

The ions can then be ejected orthogonally from the C-Trap into an ORBITRAP™ mass analyser 70 for high resolution mass analysis. Downstream of the C-trap 60 is a collision cell 80 located beyond the C-trap in a longitudinal direction without orthogonal ejection. If desired, ions may be passed through the C-trap 60 to the collision cell 80 for processing such as fragmentation, after which the processed ions may be passed back to the C-trap 60 for ejection to the ORBITRAP™ mass analyser 70 for high resolution mass analysis. Any other high-resolution mass analyser could be also employed instead, such as a TOF or FT-ICR mass analyser.

For each location, high mass resolution data are acquired in this way to ensure high-confidence identification of important components in the 2D mass spectrometric image. Depending on instrument configuration and other criteria, data obtained from the high resolution analysis might include any combination of:

high-resolution broad mass spectrum;

single or multiplexed narrow windows (so called targeted selected ion monitoring);

single or multiplexed MS/MS experiments, targeted or data-dependent mass analysis;

MSn spectral tree; and any of the above with added internal calibrant (e.g. from a separate location).

Thus the additional high mass resolution data obtained for the at least one location in a differentiated region or cluster, preferably is assigned to the corresponding region or cluster.

A combination of the high mass resolution data of the second mass analysis from the individual locations and the high spatial resolution data of the first mass analysis using the multi-pixel 2D detector, enables a consensus or conflated mass spectral image to be produced.

This approach allows either a confirmation that each feature or peak is conserved over the area of the region or cluster not only at low mass resolution (e.g. using the 2D Detector), but also at high mass resolution, or to find features or peaks that are not conserved between low and high mass resolution. Then for each detected m/z peak that is conserved, the high mass resolution data may be propagated for the entire region or cluster by assigning to every pixel (x, y) of the region or cluster this m/z value, and optionally but preferably its average intensity and/or a flag representing the degree of conservation of this m/z and thus indicating the reliability of propagation. For example, for highly conserved m/z peaks, the flag would be assigned a maximum value (e.g. 100 or S/D where D is variation of signal intensity between points of the sub-area in HR spectra), while for non-conserved (i.e. unreliable) peaks the flag would be assigned a minimum value (e.g. 1). This allows an image to be obtained with high mass resolution and high spatial (x, y) resolution with known confidence for each m/z peak in a time p=K/M-fold shorter than would be required for acquiring such image in conventional 'microprobe' analysis (rastering a small beam). It even allows a spatial resolution to be achieved that is higher than a microprobe analysis would allow (since the pixel size could be made smaller than the diameter of the microprobe beam). All of the method steps of the invention, especially all modes of mass spectrometric data acquisition, may be carried out within the same instrument without exposing the sample to atmosphere.

Across all clusters, for example each of several tens to hundreds of locations may be sampled sequentially and subject to the second, high resolution mass analysis. Typically, the high resolution analysis at each location may require between a few hundred milliseconds and a few seconds. Therefore, the process of analysing a frame (both low-resolution and high resolution analysis) may take of the order of a few minutes. In the example of FIG. 4, there are approximately 92 locations within the called-out region selected for the high resolution analysis. Therefore, even if the high resolution analysis at each of those locations takes, say, 2 seconds, the total time for high resolution analysis of these locations would be of the order of 3 minutes.

Each location for high resolution analysis may cover an area of the order of 30 μm×30 μm. In the example of FIG. 4, 92 locations (each of 30 μm×30 μm) are subject to high resolution analysis. By contrast, if the high resolution analysis were to be carried out across the entire frame (measuring 3 mm×3 mm) then 10,000 locations of the same 30 μm×30 μm would need to be analysed. If, as in the example, 92 locations were to be analysed in the order of 3 minutes then it would take of the order of 5½ hours to analyse all 10,000 locations at high resolution. The significant reduction in time of analysis, whilst still maintaining high mass and spatial resolution analysis, represents a significant advantage over the prior art.

Figure 5:
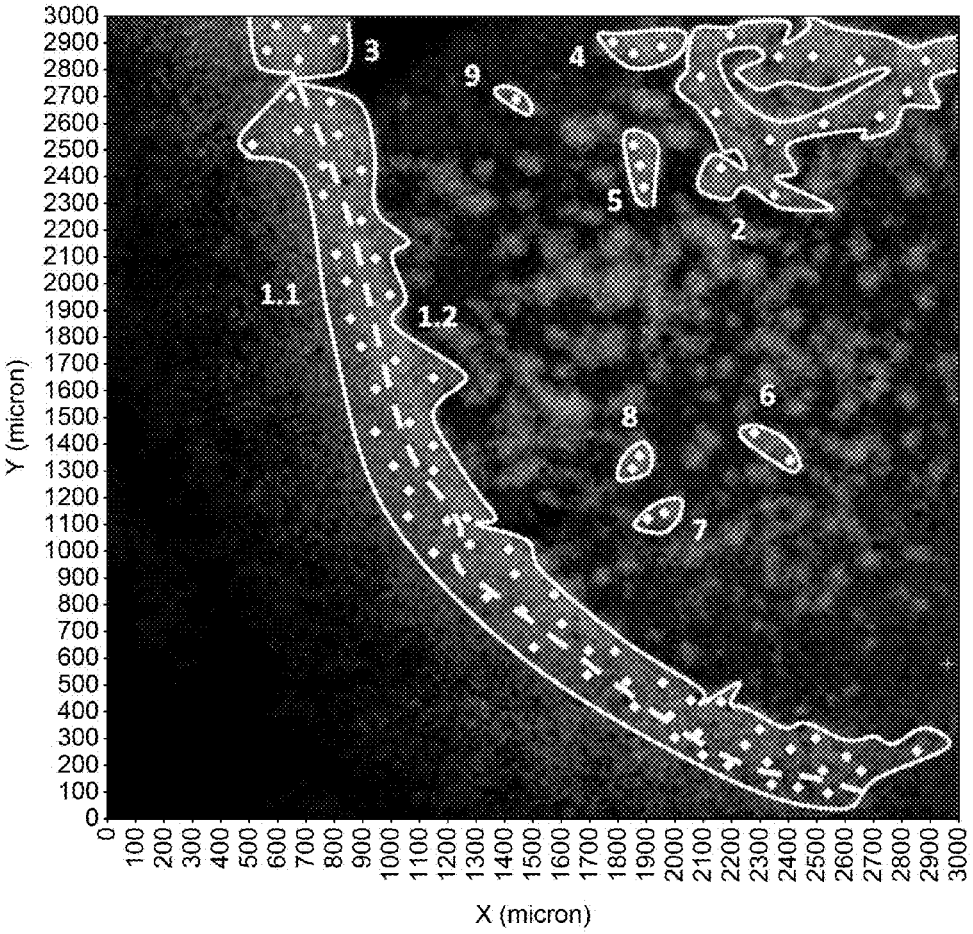
FIG. 5 shows the sample of FIG. 4, following re-analysis in accordance with an embodiment of the invention.

It may be that the high mass resolution analysis, and the additional data derived therefrom, suggests that improvements might be made to the clustering process performed following the lower mass resolution analysis. For example, in the example of FIG. 4, it may be that the clustering technique used to estimate the boundary of cluster 1, may be refined on the basis of the high mass resolution analysis performed at each of the locations identified by the white squares/diamonds. FIG. 5 shows how, in light of the high resolution analysis, cluster 1 may be considered to relate to material of insufficiently similar mass spectra. As a consequence, the clustering may be performed on the basis of the high resolution mass spectral data in order to arrive at two different clusters, labelled 1.1 and 1.2 in FIG. 5. This is illustrated in the flow chart of FIG. 2 by the feedback loop in the process that is executed when the "similarity score" for different high resolution analysis locations is considered to be too low.

It has been described how to perform the technique for a single frame (comprising 300 pixels by 300 pixels in the example of FIGS. 3 to 5). Having completed the process for a first frame, the same process of low resolution analysis, identification of regions, sub regions (clusters) and representative locations, and subsequent high resolution analysis may then be repeated for each frame of the sample in turn. (Where only a part of the sample is of interest, it is not necessary for every part of the sample to fall within a frame. It is necessary only that the entirely of the area of sample of interest is covered by a frame.)

The flow chart of FIG. 2 provides an overall control functionality that enables a wide area of a sample to be analysed using the apparatus and techniques described above, in stages, in order to perform analysis over a wide area (such as over a complete sample of several millimeters square). This is intended to provide one suggestion of how the various features and functions can be implemented together in order to produce an analysis that provides a level of confidence not achievable using only a low resolution but in a much shorter time than would be required to undertake a high resolution analysis of the whole sample. Variations to this overall control functionality are envisaged and would still fall within the scope of the appended claims.

In order to ensure alignment of the images and sampled locations (i.e. how to ensure that the focused beam in the high mass resolution mode samples the correct point relative to the points previously sampled in the wide area, low mass resolution mode) this could be achieved, for example, by calibrating the system on fine-structured calibration samples and then keeping the system stable and reproducible after that. Additionally, or alternatively, each sample could have calibration structures (lines, points, etc.) on its side so that system reproducibility is constantly validated.

The overall analysis strategy is dependent upon the data received. That is to say not only that the locations selected for high resolution analysis are selected following computation of the low resolution analysis data but also that further decisions regarding, perhaps, additional locations selected subsequently for high resolution analysis are selected on the basis of both high resolution and low resolution data already obtained. Furthermore, the controller may elect to undertake further low resolution on the basis of data obtained from previous low resolution analysis in combination with previous high resolution analysis. Moreover, acquisition conditions on subsequent analysis by the high resolution detector may be dependent upon spectral data obtained previously from the low resolution (or the high resolution) detector. Similarly, acquisition conditions on subsequent analysis by the high resolution detector may be dependent upon spectral data obtained previously from the high resolution (or the low resolution) detector. In short, the overall analysis strategy may be dynamic and the approach to later analyses may be influenced by data obtained from earlier analyses.

The invention claimed is:

1. A method of performing imaging mass spectrometry of a sample, the method comprising:

performing a first mass analysis of the sample using a first mass analyzer comprising a multi-pixel ion detector to obtain first mass spectral data representative of pixels of the sample;

identifying clusters of pixels sharing one or more characteristics of first mass spectral data; and performing a second mass analysis of the sample using a second mass analyzer to obtain second mass spectral data at at least one location in each cluster, wherein the second mass analysis being of higher resolution than said first mass analysis, wherein ionization conditions for the first mass analyzer are different from ionization conditions for the second mass analyzer.

2. The method of claim 1 wherein the number of locations is significantly less than the number of pixels in each cluster.

3. The method of claim 1 and further comprising conflating the first and second mass spectral data to obtain a mass spectral image of the sample that has the spatial resolution of the first mass spectral data and the mass resolution of the second mass spectral data.

4. The method of claim 1 wherein the first mass analyzer performs mass analysis in at least 1,000 channels in parallel.

5. The method of claim 1 wherein the second mass analyzer performs mass analysis in not more than 10 channels in parallel.

6. The method of claim 1 wherein the product of a pixel rate by resolving power is significantly higher for the first mass analyzer than for the second mass analyzer.

7. The method of claim 1 further comprising irradiating the sample with an ionization beam to provide ions for the first mass analysis and second mass analysis and focussing the ionization beam to a smaller area of the sample for the second mass analysis compared to the first mass analysis.

8. The method of claim 1 wherein the number of clusters is at least 10 times less than the total number of pixels.

9. The method of claim 1 wherein the step of performing the second mass analysis at at least one location in each cluster includes:

identifying a first location of the one or at least one locations by identifying a pixel within the cluster having a highest similarity of shared characteristics of mass spectral data with one or more immediately adjacent pixels.

10. The method of claim 9 wherein the step of performing the second mass analysis is performed at more than one location in each cluster and further includes:

identifying a second location by identifying a pixel within the cluster having a high similarity of shared characteristics of mass spectral data with immediately adjacent pixels and wherein the pixels of the second location have a low similarity of characteristics with the pixels of the first location.

11. The method of claim 1 wherein the step of performing the second mass analysis at at least one location in each cluster includes:

identifying a plurality of locations substantially equally spaced apart within each cluster.

12. The method of claim 1 wherein a power of an ionization beam is greater for the second mass analysis compared to the first mass analysis.

13. A mass spectrometry apparatus comprising:

a first mass analyzer comprising a multi-pixel ion detector for undertaking first mass analysis of a sample to provide first mass spectral data in the form of a mass spectral image of the sample;

a second mass analyzer for undertaking second mass analysis of the sample to provide second mass spectral data of higher mass resolution than the first mass spectral data;

a controller configured:

to analyzer the mass spectral image;

to identify within that mass spectral image clusters of spectrally similar pixels;

to configure the second mass analyzer to analyze one or more locations within each cluster to a higher resolution than that provided by the first mass analyzer, wherein ionization conditions for the first mass analyzer are different from ionization conditions for the second mass analyzer.

14. The mass spectrometry apparatus of claim 13 wherein the number of locations is significantly less than the number of pixels in each cluster.

15. The mass spectrometry apparatus of claim 13 wherein the first mass analyzer is a time-of-flight mass analyzer.

16. The mass spectrometry apparatus of claim 13 wherein the second mass analyzer is a time-of-flight mass analyzer or an electrostatic trap mass analyzer or an FT-ICR mass analyzer.

17. The mass spectrometry apparatus of claim 16 wherein the second mass analyzer is an electrostatic trap mass analyzer and wherein the electrostatic trap mass analyzer is an orbital trap mass analyzer.

18. The mass spectrometry apparatus of claim 13 further comprising a beam diverter configured to divert a direction of flow of ions towards either the first mass analyzer or the second mass analyzer.

19. The mass spectrometry apparatus of claim 18 wherein the beam diverter comprises a first mode and a second mode, wherein in the first mode the beam diverter results in a change in the direction of flow of ions flowing through the beam diverter and in the second mode the beam diverter has minimal or no effect on the direction of flow of ions through the beam diverter.

20. The mass spectrometry apparatus of claim 19 wherein the first mass analyzer is located relative to a sample receiving portion such that a flow path of ions between the sample receiving portion and the first mass analyzer is substantially rectilinear and wherein the second mass analyzer is located relative the sample receiving portion such that a flow path of ions between the sample receiving portion and the second mass analyzer requires a change in the direction of the flow path of ions.

21. The mass spectrometry apparatus of claim 18 wherein the beam diverter comprises a bent multipole 30.

22. The mass spectrometry apparatus of claim 13 wherein a power of an ionization beam is greater for the second mass analysis compared to the first mass analysis.

* * * * *